United States Patent [19]

Mori et al.

[11] Patent Number: 4,515,702

[45] Date of Patent: May 7, 1985

[54] HEAT-RESISTANT SILICONE FLUID COMPOSITIONS

[75] Inventors: Shigeru Mori, Gunma; Yoshiaki Kudo, Tokyo; Satoshi Kuwata, Gunma, all of Japan

[73] Assignee: Shin-Etsu Chemical Co., Ltd., Tokyo, Japan

[21] Appl. No.: 597,455

[22] Filed: Apr. 5, 1984

[30] Foreign Application Priority Data

Apr. 12, 1983 [JP] Japan ..... 58-64095

[51] Int. Cl.[3] ..... C10M 1/50

[52] U.S. Cl. ..... 252/49.6; 252/50; 556/422

[58] Field of Search ..... 252/49.6, 50; 260/448.2 N

[56] References Cited

U.S. PATENT DOCUMENTS

| | | | |
|---|---|---|---|
| 3,026,263 | 3/1962 | Arimoto | 252/49.6 |
| 3,714,044 | 1/1973 | Kim | 252/49.6 |
| 3,896,032 | 7/1975 | Stroh et al. | 252/49.6 |
| 4,327,140 | 4/1982 | Preston | 252/49.6 |

*Primary Examiner*—Jacqueline V. Howard

*Attorney, Agent, or Firm*—Toren, McGeady, Stanger, Goldberg & Kiel

[57] ABSTRACT

A highly heat-resistant silicone fluid composition is proposed which comprises a conventional silicone fluid as the base component and a small amount of an additive organopolysiloxane modified with aromatic amino-containing groups such as 4-(p-semidino)phenyl, 4-(α-naphthylamino)phenyl and 4-(β-naphthylamino)phenyl groups bonded to the silicone atoms either directly or through an oxygen atom.

2 Claims, No Drawings

HEAT-RESISTANT SILICONE FLUID COMPOSITIONS

BACKGROUND OF THE INVENTION

The present invention relates to a heat-resistant silicone fluid composition or, more particularly, to a heat-resistant silicone fluid composition having excellent durability even by prolonged heating at an elevated temperature of 200° C. or higher.

Although silicone fluids are superior in the heat resistance or stability at high temperatures to mineral oils and oils of animal or vegetable origin, as is well known, silicone fluids are also not free from gradual oxidation in air when heated at 200° C. or higher so that no satisfactory durability can be expected for silicone fluids used as a lubricating oil or a working fluid exposed to relatively high temperatures. Accordingly, it is a common practice that a silicone fluid to be used at an elevated temperature is admixed with an antioxidant in order to enhance the durability or usuable life while a problem in the use of an antioxidant in silicone fluids is that most of the antioxidant compounds are insoluble in or incompatible with silicone fluids so that no uniform silicone fluid composition can be obtained by the admixture of an antioxidant or the antioxidant dissolved or dispersed by a mechanical means in a silicone fluid with heating may be readily lost by dissipation when the silicone fluid is exposed to a high temperature atmosphere so that no satisfactory results can be obtained in this way of admixing a conventional antioxidant.

SUMMARY OF THE INVENTION

It is therefore an object of the present invention to provide a novel heat-resistant silicone fluid composition free from the above described problems in the prior art due to the incompatibility and dissipation of an antioxidant admixed therewith.

Thus, the heat-resistant silicone fluid composition provided by the invention comprises:

(a) 100 parts by weight of an organopolysiloxane represented by the average unit formula $$R^1{}_aSiO_{\frac{4-a}{2}}, \qquad (I)$$

in which $R^1$ is an alkyl group or a phenyl group and a is a positive number from 1.95 to 2.25, and having a viscosity in the range from 10 to 1,000,000 centistokes at 25° C.; and (b) from 0.01 to 5 parts by weight of an aromatic amino-modified organopolysiloxane represented by one of the following general formulas $$R^2-O\left(SiR^1{}_2-O\right)_pR^2 \text{ and} \qquad (II)$$

$$R^1{}_3-Si-O\left(SiR^1{}_2-O\right)_q\left(\underset{\underset{O-R^2}{|}}{SiR^1}-O\right)_rSiR^1{}_3, \qquad (III)$$

in which $R^1$ has the same meaning as defined above, $R^2$ is an aromatic amino group selected from the class consisting of 4-(p-semidino)phenyl group of the formula

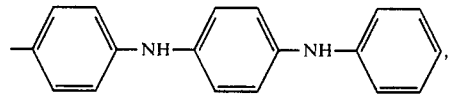

4-(α-naphthylamino)phenyl group of the formula

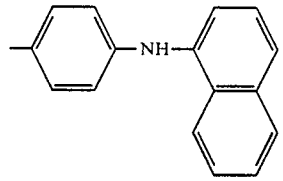

and 4-(β-naphthylamino)phenyl group of the formula

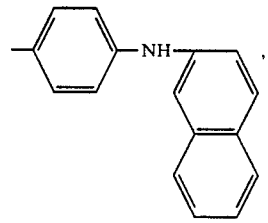

p is a positive integer from 1 to 50 inclusive, q is zero or a positive inte-ger not larger than 47 and r is a positive integer from 1 to 10 inclusive with the proviso that q+r is in the range from 1 to 48.

DETAILED DESCRIPTION OF THE PREFERRED EMBODIMENTS

The above described formulation of the heat-resistant silicone fluid composition of the present invention has been established as a result of the extensive investigations undertaken by the inventors with an object to develop a highly heat-resistant silicone fluid composition free from the problems and disadvantages in the prior art silicone fluid compositions admixed with an antioxidant leading to the discovery that certain aromatic amino-modified organopolysiloxane has good compatibility with silicone fluids to give a uniform silicone fluid composition which is imparted with greatly improved heat-resistance and durability when prolongedly heated at a temperature of 200° C. or higher so that the viscosity increase of the silicone fluid composition admixed with such a modified organopolysiloxane is extremely small.

The principal component in the inventive silicone fluid composition is the organopolysiloxane represented by the average unit formula (I) in which $R^1$ is an alkyl group, e.g. methyl, ethyl or propyl group, or a phenyl group and the suffix a has a value from 0.95 to 2.25. It is preferable that at least 80% by moles of the organic groups denoted by the symbol $R^1$ are methyl groups from the standpoint of obtaining a silicone fluid composition of particularly high heat resistance. This organopolysiloxane should have a viscosity in the range from 10 to 1,000,000 centistokes at 25° C. since an organopolysiloxane having a viscosity lower than above has a high vapor pressure with volatility so that such a silicone fluid is not suitable as a component of a heat-resistant silicone fluid composition for high-temperature use while an organopolysiloxane having a viscosity in excess of the above range is scarcely flowable and cannot be used as a lubricating oil or a working fluid.

The component (b), which serves as a heat resistance improver of the component (a), is an aromatic amino-modified organopolysiloxane represented by the general formula (II) or (III) given above in which the group denoted by $R^2$ is a 4-(p-semidino)phenyl, 4-(α-naphthylamino)phenyl or 4-(β-naphthyl-amino)phenyl group as described above. The suffixes p, q and r each should have a value as given above. The value of p should be from 1 to 50 since the component (b) of the formula (II) in which the value of p exceeds 50 has a correspondingly low content of the amino-modified aromatic groups so that the amount of the component (b) in the composition must be increased so much. In connection with the limitations for the suffixes q and r in the formula (III) that r should be 1 to 10 and q+r should be 1 to 48, the component (b) expressed by the formula (III) in which r is larger than 10 is less compatible with the component (a) so that difficulties are encountered in preparing a uniform composition and the component (b) of the formula (III) in which q+r is larger than 48 with a value of r being sufficiently small to ensure good compatibility of the components (a) and (b) has a low content of the amino-modified aromatic groups so that the amount of the component (b) must be increased so much.

The amount of the component (b) relative to the component (a) should be in the range from 0.01 to 5 parts by weight per 100 parts by weight of the component (a) because no satisfactory improvement can be obtained in the heat resistance of the composition when the amount of the component (b) is smaller than the above range while the uniformity of the composition is decreased when the amount of the component (b) is larger than the above range relative to the component (a) as a result of the limited solubility therebetween.

The aromatic amino-modified organopolysiloxane as the component (b) can readily be synthesized by the reaction of an organopolysiloxane having reactive groups and an aromatic amino-substituted phenolic compound such as 4-(p-semidino)phenol, 4-(α-naphthylamino)phenol and 4-(β-naphtylamino)phenol. The above mentioned reactive organopolysiloxane can be an alkylpolysiloxane having chlorine atoms directly bonded to the silicon atoms which is reacted with the above exemplified amino-modified phenolic compound in an equimolar amount to the silicon-bonded chlorine atoms in toluene as the solvent in the presence of an acceptor for hydrogen chloride such as pyridine, triethylamine and the like at room temperature or an elevated temperature under agitation followed by the removal of the precipitated hydrochloride and stripping of the solvent under reduced pressure.

The heat-resistant silicone fluid composition of the invention is prepared by merely blending the components (a) and (b) in the specified proportion. The conditions for blending are not particularly limitative including the atmospheric condition which may be under atmospheric air or under sealing with an inert gas such as nitrogen when possible oxidation of the organopolysiloxanes during the procedure should be avoided. The thus prepared silicone fluid composition of the invention can be used as such in the applications as a lubricating oil, working fluid and the like. Further, the silicone fluid composition is suitable as a base oil for the preparation of a silicone grease usable at hilgh temperatures by formulating with a thickener and other additives used in silicone greases.

Following are the examples to illustrate the formulation and high-temperature performance of the inventive silicone fluid compositions in comparison with conventional silicone fluids.

EXAMPLES 1 TO 8 AND COMPARATIVE EXAMPLES 1 AND 2

Silicone fluid compositions were prepared each by uniformly blending 100 parts by weight of a dimethylpolysiloxane terminated at both molecular chain ends each with a trimethylsilyl group and having a viscosity of 7800 centistokes at 25 ° C. with either one of the aromatic amino-modified organopolysiloxanes (A) to (F) expressed by the following structural formulas, in which the symbol Me denotes a methyl group, in an amount indicated in Table 1 below and the mixture was agitated at 250 ° C. for 3 hours under an atmosphere of nitrogen gas.

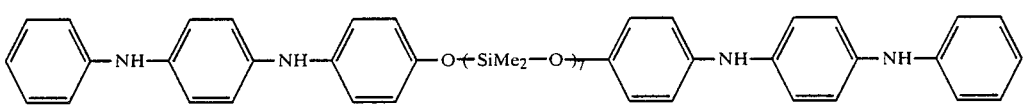

(A)

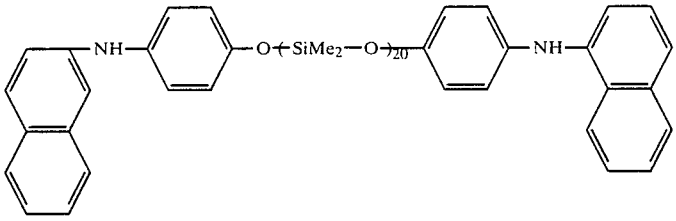

(B)

-continued

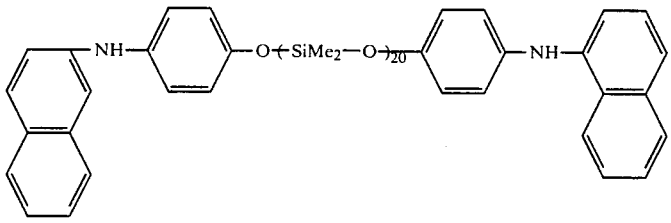

(C)

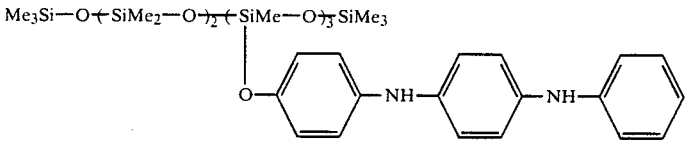

(D)

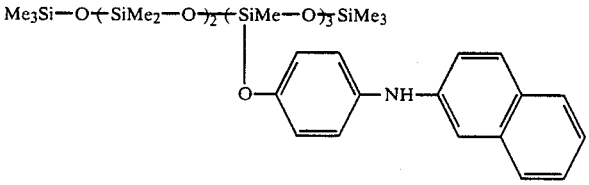

(E)

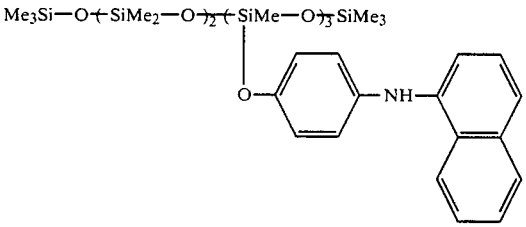

(F)

A 30 g portion of each of the thus prepared silicone fluid compositions was taken in a 100 ml glass beaker kept in an air-circulation oven at 250 ° C. for 24, 72 or 144 hours and the viscosity of the fluid was determined at 25° C. The results are given in Table 1 by the ratio of the viscosity of the fluid after heating to the initial value.

For comparison, two comparative tests were undertaken concurrently by replacing the inventive silicone fluid composition above described with the same dimethylpolysiloxane used in the above preparations alone (Comparative Example 1) or with a mixture of 100 parts by weight of the same dimethylpolysiloxane and 0.6 part by weight of a 4-anilinophenoxy-terminated dimethylpolysiloxane (G) expressed by the formula

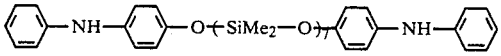

(G)

(Comparative Example 2) to give the results also shown in Table 1.

TABLE 1

| Example No. | | Aromatic amino-modified organo-polysiloxane: Type | Amount of addition, parts by weight | Viscosity relative to initial value after heating at 250° C. for: 24 hours | 72 hours | 144 hours |
|---|---|---|---|---|---|---|
| Inventive | 1 | A | 0.05 | 0.81 | 0.71 | 0.76 |
| | 2 | A | 0.2 | 0.88 | 0.79 | 0.82 |

TABLE 1-continued

| Example No. | | Aromatic amino-modified organo-polysiloxane: Type | Amount of addition, parts by weight | Viscosity relative to initial value after heating at 250° C. for: 24 hours | 72 hours | 144 hours |
|---|---|---|---|---|---|---|
| | 3 | A | 5.0 | 0.71 | 1.18 | 3.60 |
| | 4 | B | 0.5 | 0.92 | 0.87 | 1.00 |
| | 5 | C | 0.5 | 0.87 | 1.09 | 2.71 |
| | 6 | D | 0.3 | 0.85 | 0.74 | 0.89 |
| | 7 | E | 0.3 | 0.93 | 1.10 | 1.85 |
| | 8 | F | 0.3 | 0.93 | 0.75 | 0.72 |
| Comparative | 1 | — | — | gelled | — | — |
| | 2 | G | 0.6 | 0.94 | 4.94 | gelled |

What is claimed is:

1. A heat-resistant silicone fluid composition which comprises:

(a) 100 parts by weight of an organopolysiloxane represented by the average unit formula $$R_a^1SiO_{\frac{4-a}{2}},$$

in which $R^1$ is an alkyl group or a phenyl group and a is a positive number from 0.95 to 2.25, and having a viscosity in the range from 10 to 1,000,000 centistokes at 25 ° C.; and (b) from 0.01 to 5 parts by weight of an aromatic amino-modified organopolysiloxane represented by the general formula $$R^2-O\left(SiR_2^1-O\right)_p R^2$$

or $$R_3^1Si-O\left(SiR_2^1-O\right)_q\left(\underset{\underset{O-R^2}{|}}{SiR^1}-O\right)_r SiR_3^1,$$

in which $R^1$ has the same meaning as defined above, $R^2$ is an aromatic amino-substituted group selected from the class consisting of 4-(p-semidino)phenyl, 4-(α-naphthylamino)phenyl and 4-(β-naphthylamino)phenyl groups, p is a positive integer from 1 to 50 inclusive, q is zero or a positive integer not larger than 47 and r is a positive integer from 1 to 10 inclusive with the proviso that q+r is in the range from 1 to 48.

2. The heat-resistant silicone fluid composition as claimed in claim 1 wherein at least 80% by moles of the groups denoted by $R^1$ in the component (a) are methyl groups.

* * * * *